US006573034B2

(12) United States Patent
Murabayashi

(10) Patent No.: US 6,573,034 B2
(45) Date of Patent: Jun. 3, 2003

(54) METHOD OF RESTORING BLACK-AND-WHITE PICTURE UNDER AGING PHENOMENA

(75) Inventor: Takao Murabayashi, Tokyo (JP)

(73) Assignee: Photo Murabayashi Ltd., Tokyo (JP)

( * ) Notice: Subject to any disclaimer, the term of this patent is extended or adjusted under 35 U.S.C. 154(b) by 8 days.

(21) Appl. No.: 09/769,937

(22) Filed: Jan. 25, 2001

(65) Prior Publication Data

US 2002/0098450 A1 Jul. 25, 2002

(51) Int. Cl.[7] ..... G03C 5/26
(52) U.S. Cl. ..... 430/401
(58) Field of Search ..... 430/401

(56) References Cited

U.S. PATENT DOCUMENTS 4,323,974 A * 4/1982 Sekigawa ..... 382/272
4,356,555 A * 10/1982 Ejiri et al. ..... 382/254

* cited by examiner

*Primary Examiner*—Hoa Van Le
(74) *Attorney, Agent, or Firm*—Jordan and Hamburg LLP

(57) ABSTRACT

Method of restoring black-and-white picture under aging phenomena includes ethylene alcohol wipe process proceeded to wipe a surface of photograph dry plate or negative film taken the black-and-white picture and preserved for a long term by ethylene alcohol and allow it to dry; silver mirror removal process proceeded to wipe and drop a silver part on the surface of image of the photograph dry plate or negative film by silver mirror removal liquid after the ethylene alcohol wipe process is proceeded; and tail end process proceeded such that the photograph dry plate or negative film removed the silver mirror in the removal process is washed in dear water by water or stream and it can be dried. Accordingly, the silver mirror part on the surface of the image on the photograph dry plate or negative film of the black-and-white picture under aging phenomena is removed, or a metallic uniting silver is disarranged, and the silver mirror part can be replaced with silver which makes original black, so that it is possible to restore it to the photograph dry plate or negative film that obtains an original black-and-white picture.

2 Claims, 13 Drawing Sheets

METHOD OF RESTORING BLACK-AND-WHITE PICTURE UNDER AGING PHENOMENA

BACKGROUND OF THE INVENTION

The present invention relates generally to a method of restoring the black-and-white picture under aging phenomena, the method restoring the aging phenomena such as silver mirror ("Gin Kabun" in Japanese), discoloration or the like of the photograph dry plate, negative film or black-and-white picture which is taken a picture of the black-and-white and is preserved for a long term.

In the conventional photograph dry plate, negative film or black-and-white picture taken the black-and-white picture, silver formed the image comes to shoot metallic luster on the surface of the image and it changes to the silver mirror by the preservation of a long term so far, and the silver mirror appears remarkably in the shade part of the image. Accordingly, the decrease in the picture quality is invited, and there is a fault of ruining original consideration to which the photograph is involved and the meaning

SUMMARY OF THE INVENTION

Accordingly, it is an object of the present invention to provide the method of restoring the black-and-white picture under aging phenomena that can be made an original black-and-white picture, photograph dry plate or negative film with silver which makes original in the silver part black by disarranging a metallic uniting the removal or silver and replacing the silver part on the surface of the image of the black-and-white picture changed.

The novel features which are believed to be characteristic of the invention, both as to its organization and method of operation, together with further objects and advantages thereof, are described below with reference to the accompanying drawings in which a presently preferred embodiment of the invention is illustrated as an example.

It is to be expressly understood, however, that the drawings are for the purpose of illustration and description only and are not intended as a definition of the limits of the invention.

DETAILED DESCRIPTION

Figure 1:
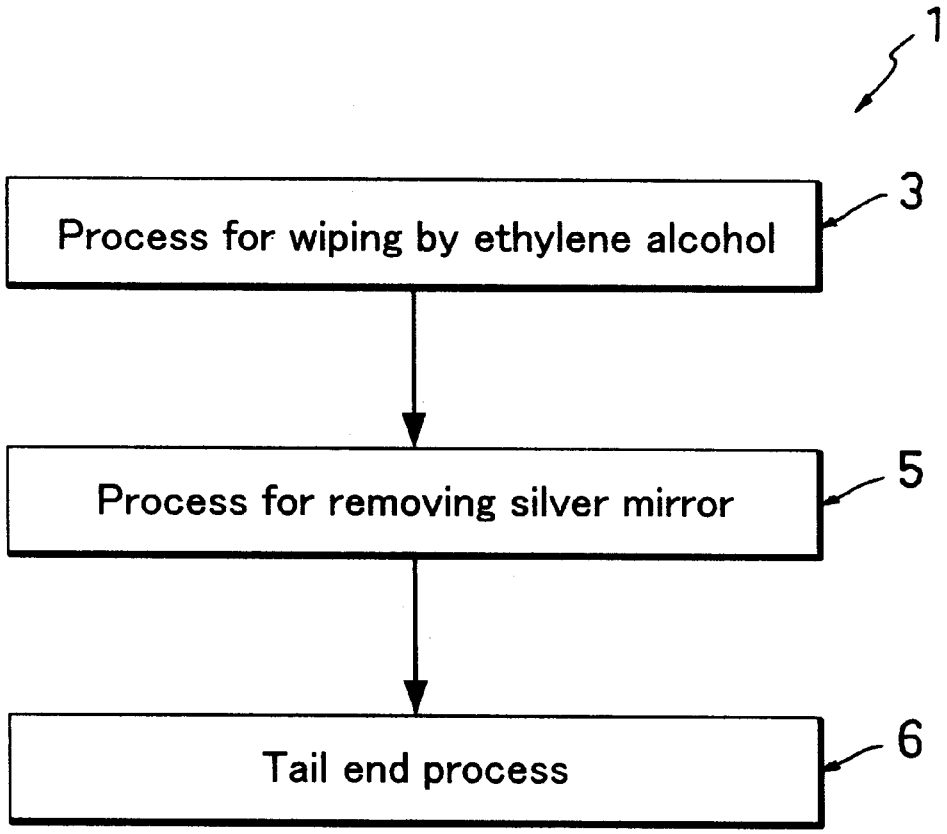
FIG. 1 is a view of a process showing a first embodiment of the present invention.
Figure 2:
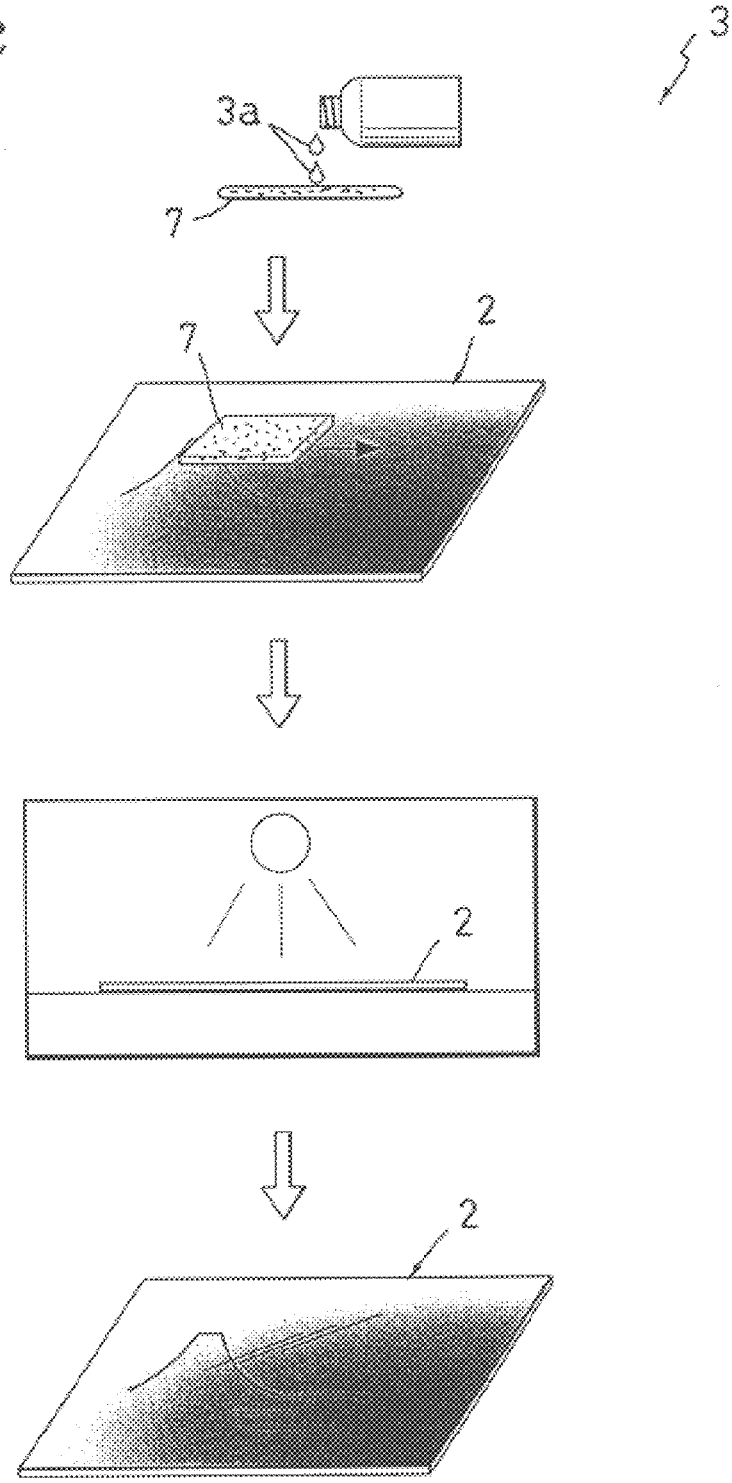
FIG. 2 is an explanation view of a process for wiping by ethylene alcohol.
Figure 3:
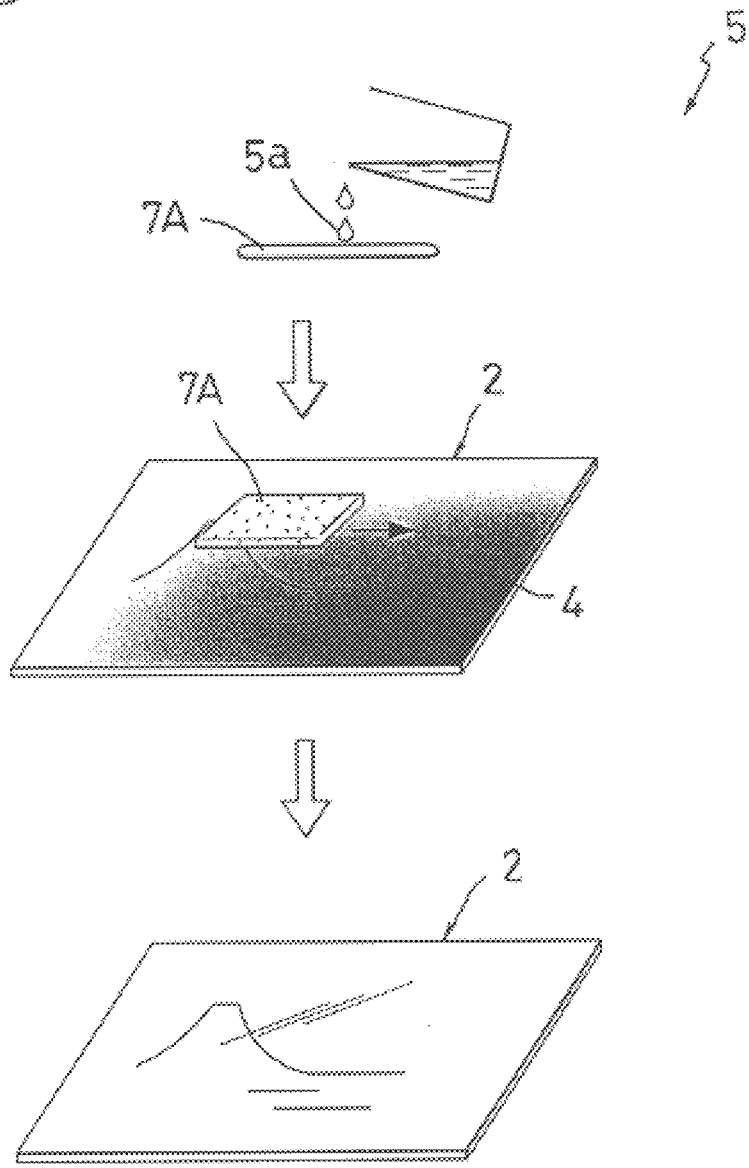
FIG. 3 is an explanation view of a process for removing silver mirror.
Figure 4:
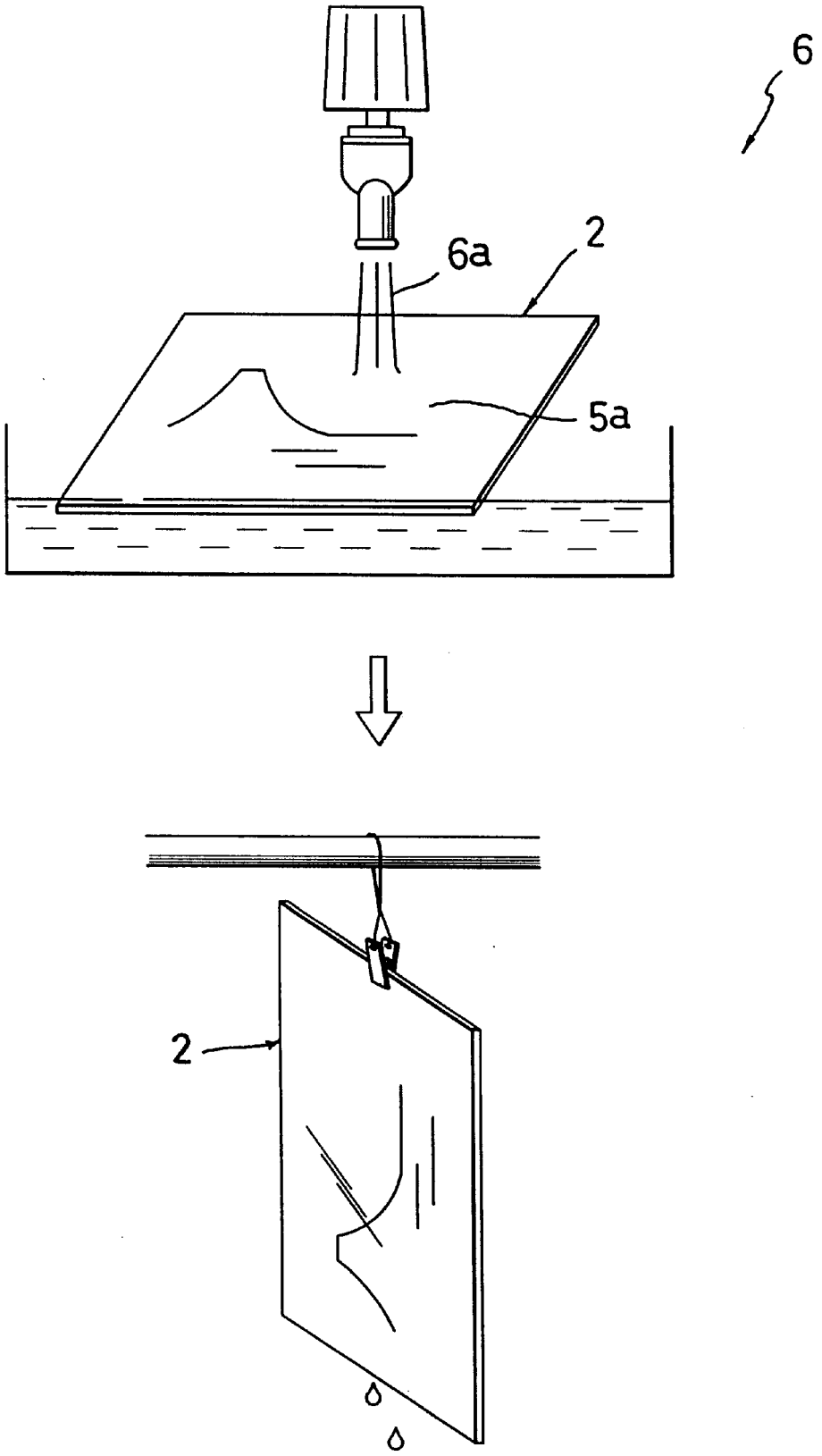
FIG. 4 is an explanation view of a tail end process.
Figure 5:
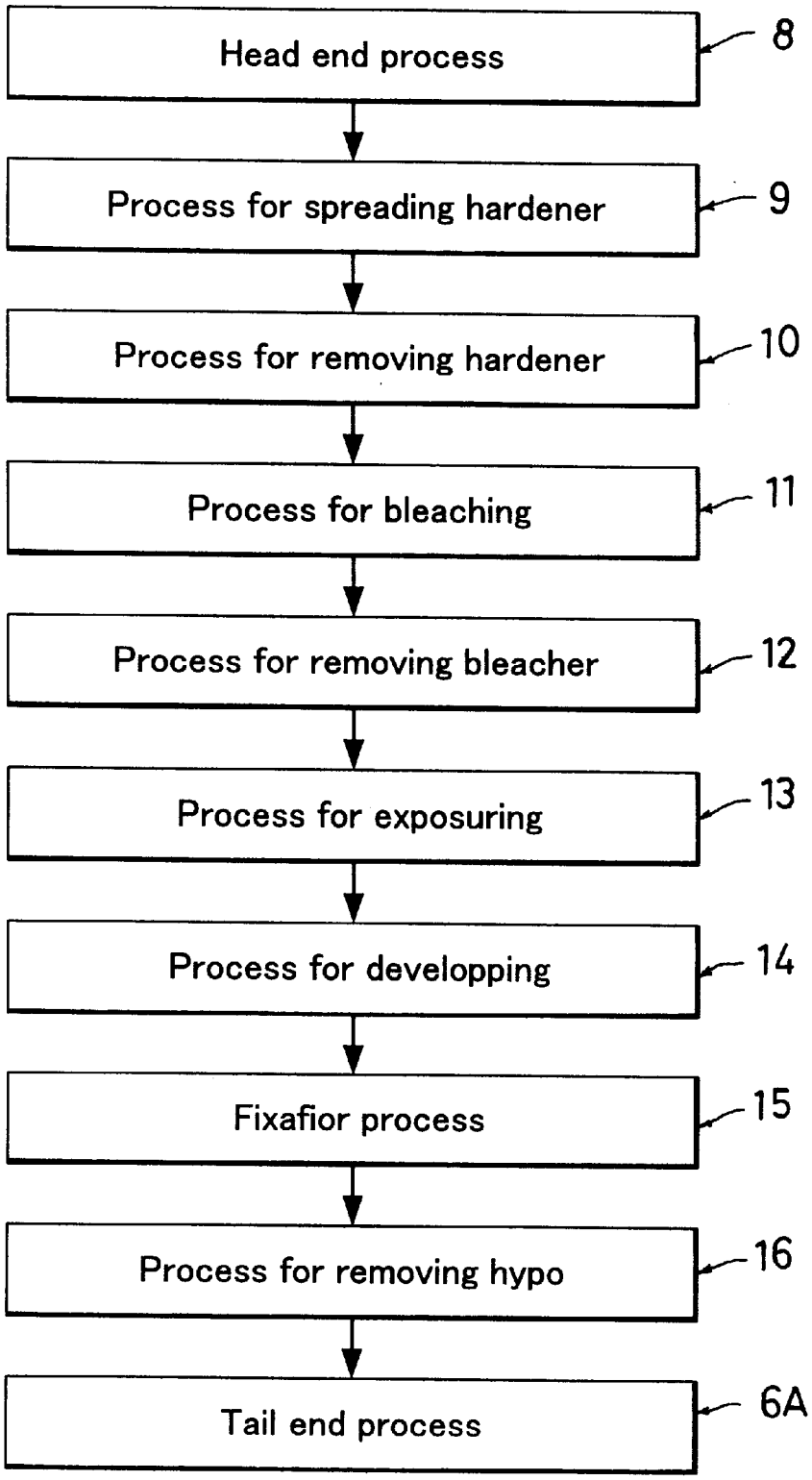
FIG. 5 is a view of a process showing a second embodiment of the present invention.
Figure 6:
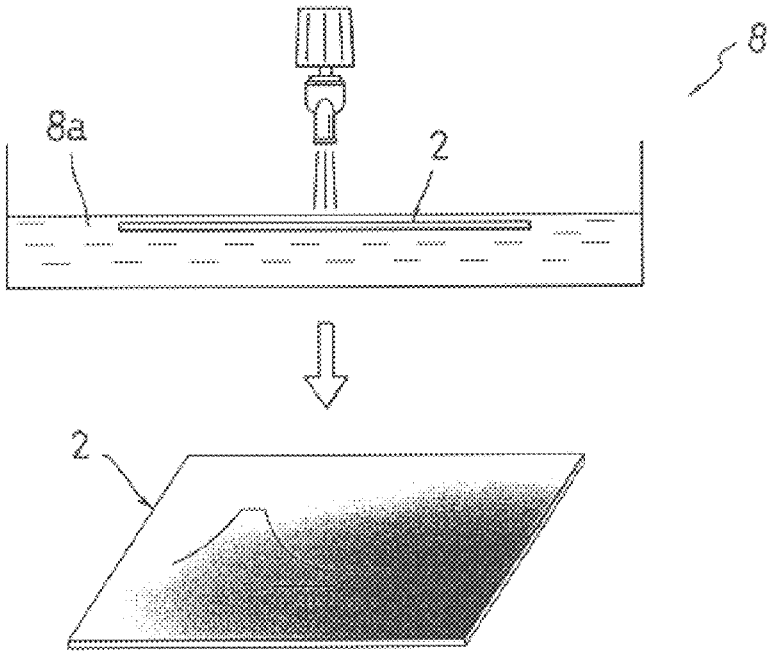
FIG. 6 is an explanation view of a preprocessing process.
Figure 7:
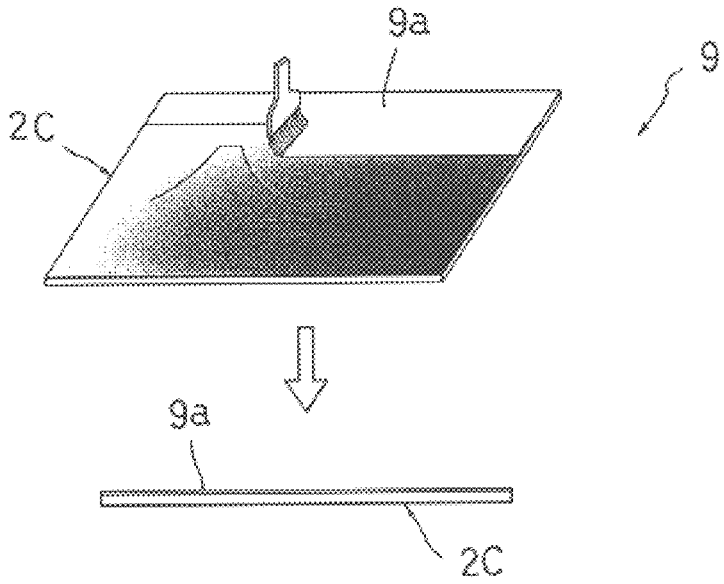
FIG. 7 is an explanation view of a process for spreading hardener.
Figure 8:
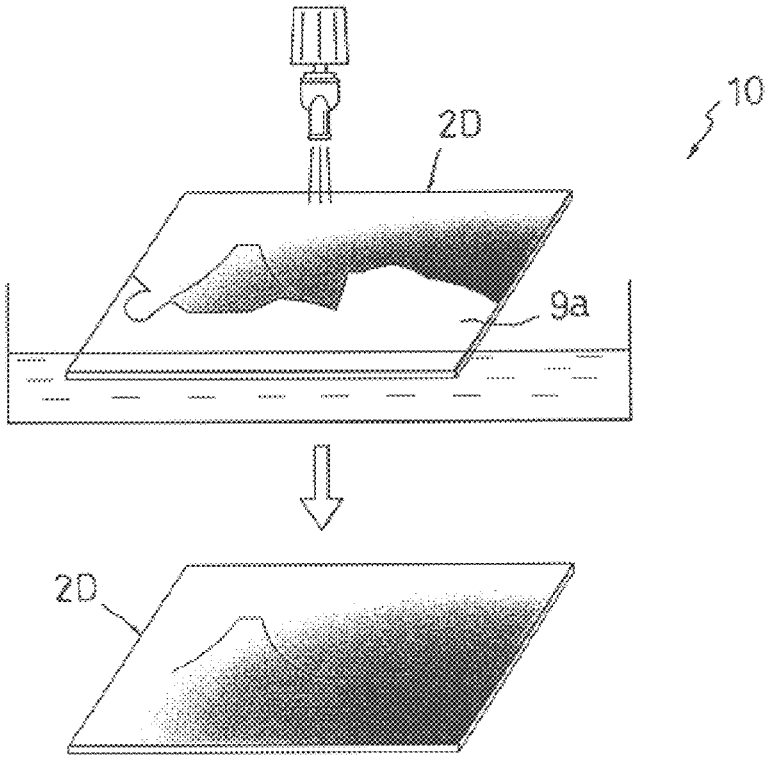
FIG. 8 is an explanation view of a process for removing hardener.
Figure 9:
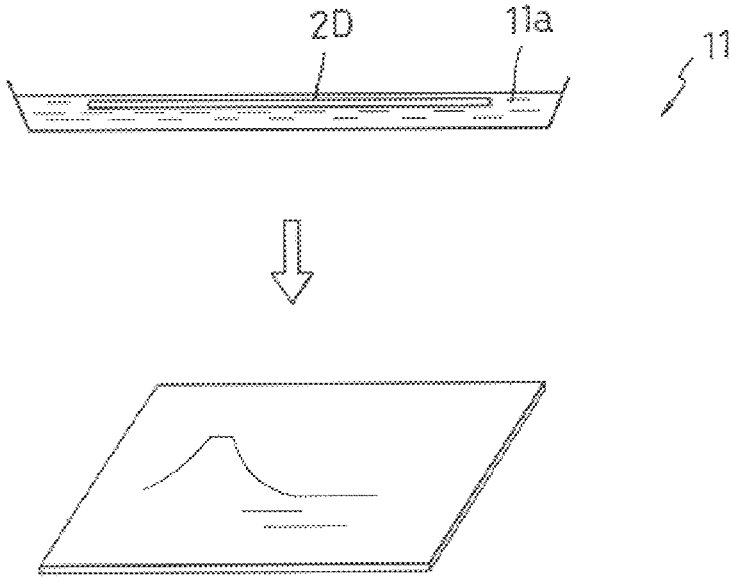
FIG. 9 is an explanation view of a process for bleaching.
Figure 10:
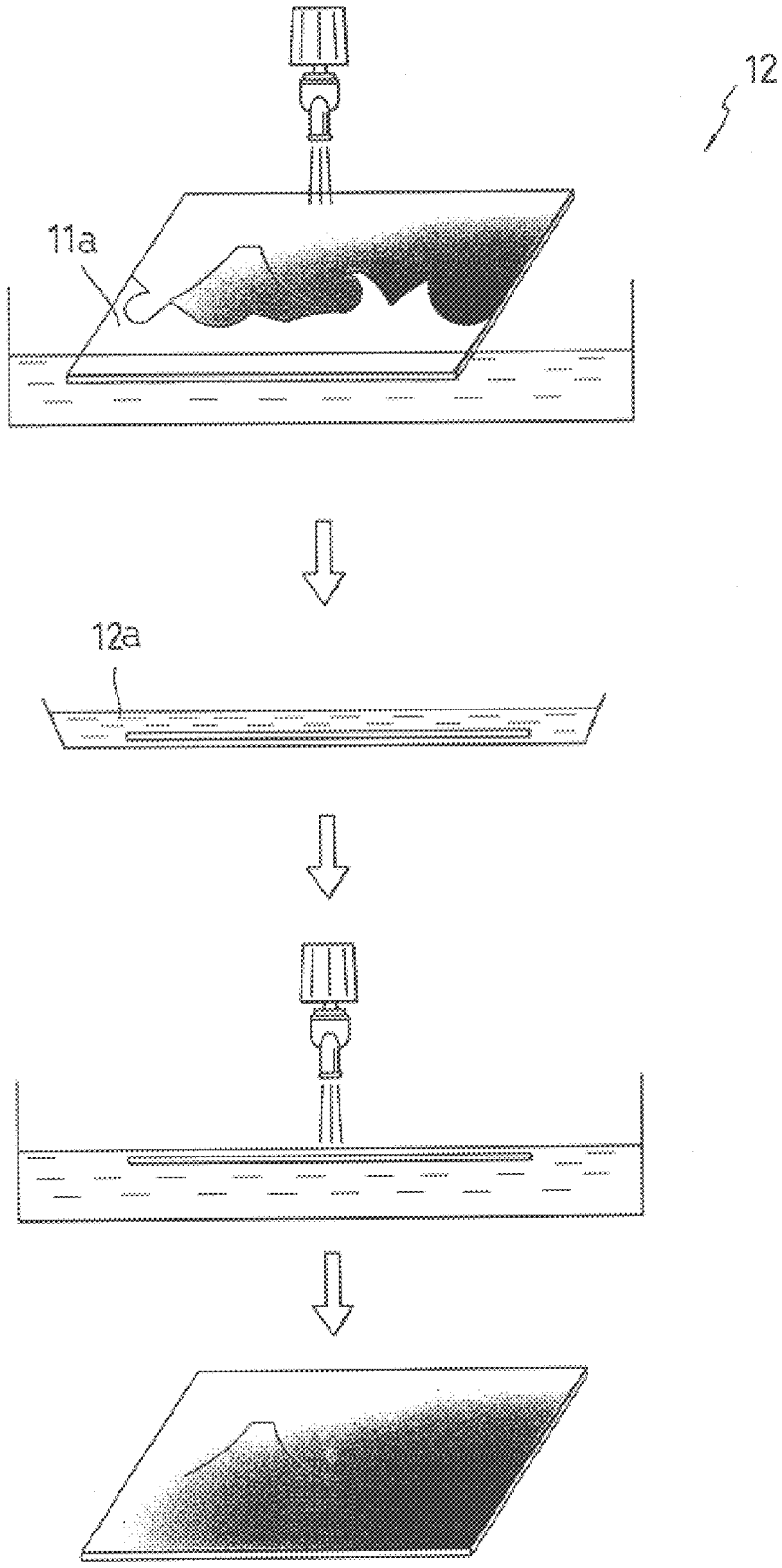
FIG. 10 is an explanation view of a process for removing bleacher.
Figure 11:
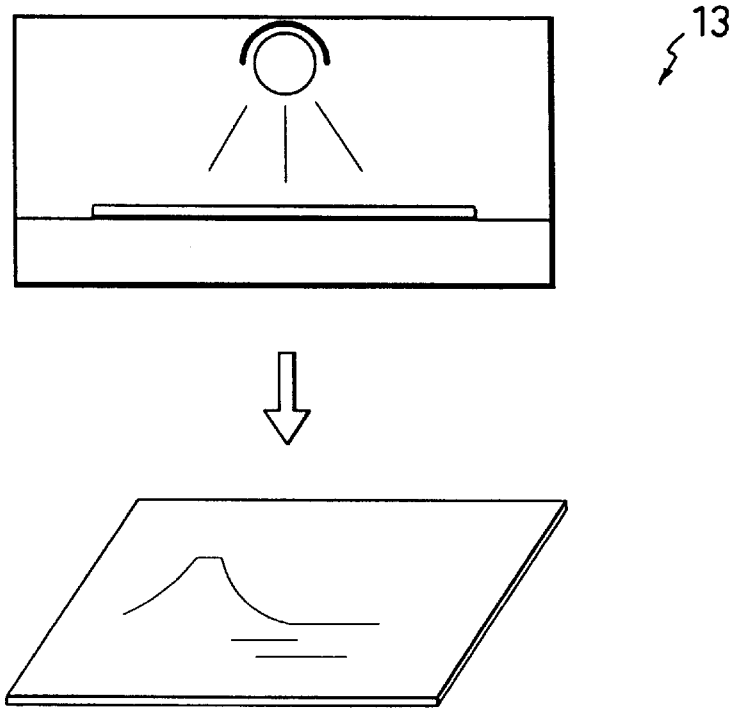
FIG. 11 is an explanation view of process for exposuring.
Figure 12:
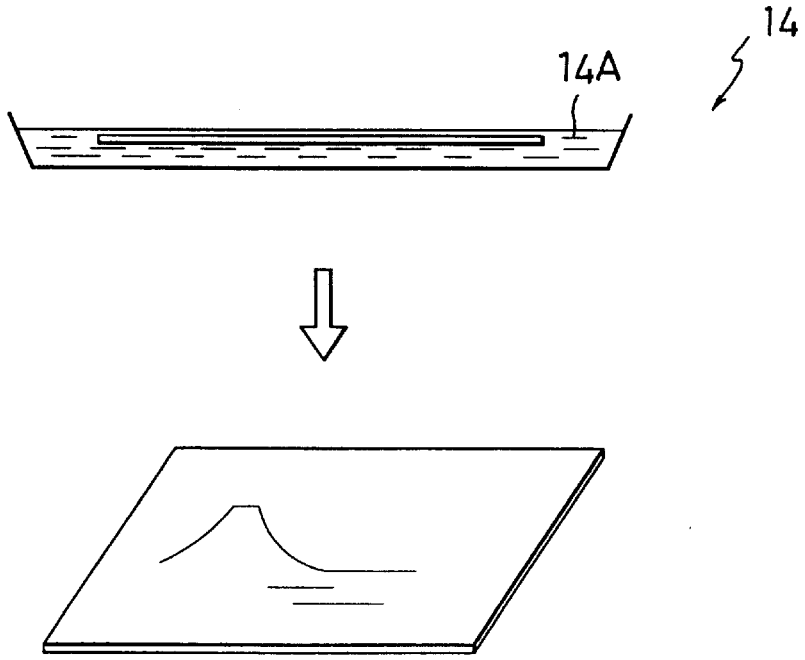
FIG. 12 is an explanation view of process for developing.
Figure 13:
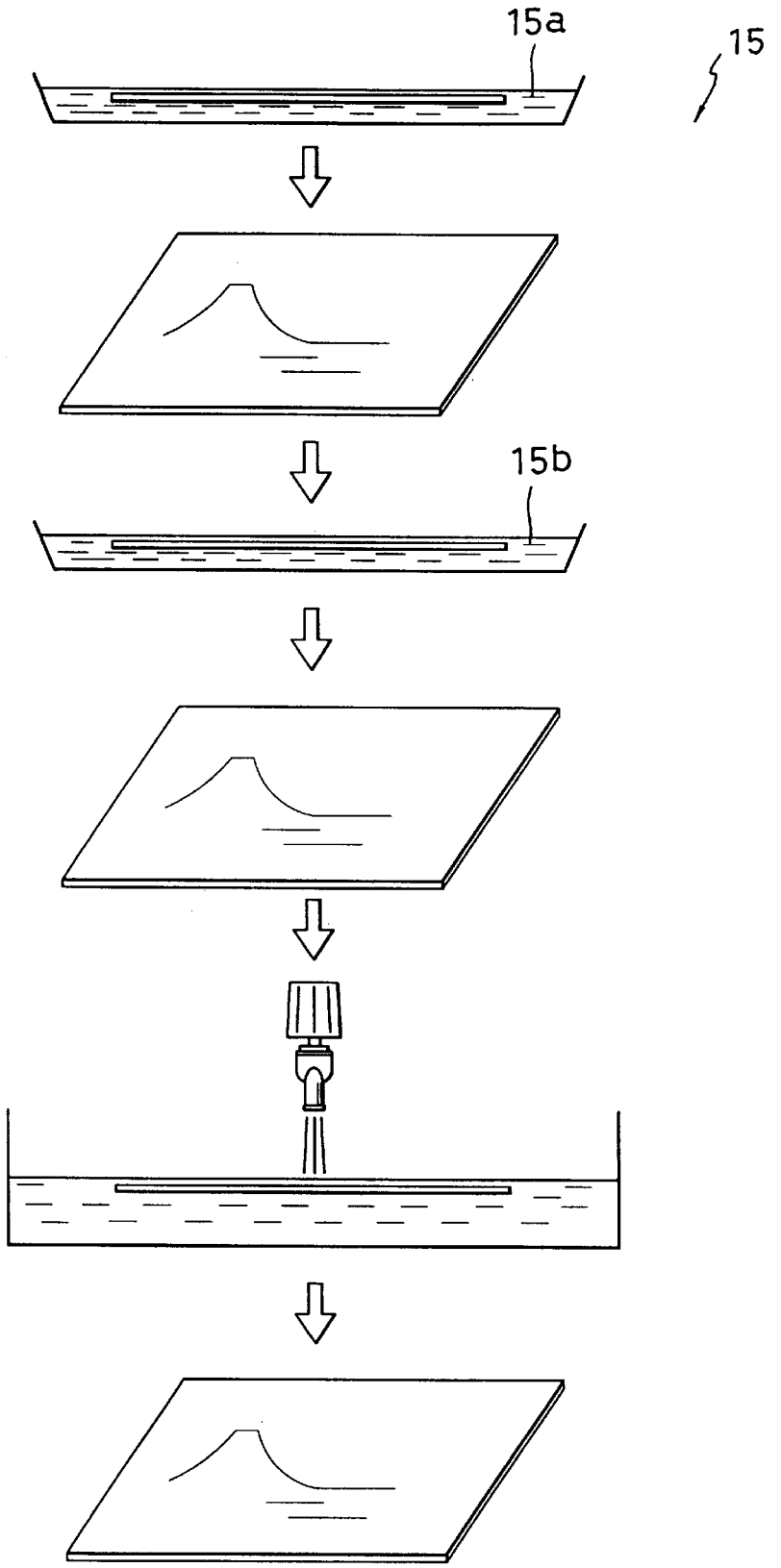
FIG. 13 is an explanation view of a fixation process.
Figure 14:
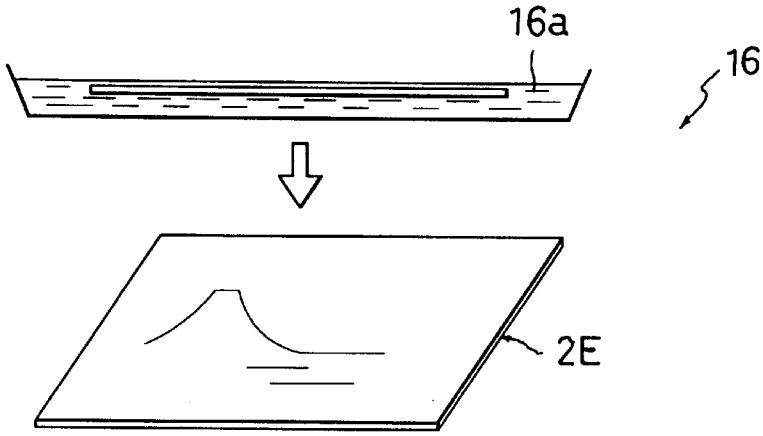
FIG. 14 is an explanation view of a process for removing hypo.
Figure 15:
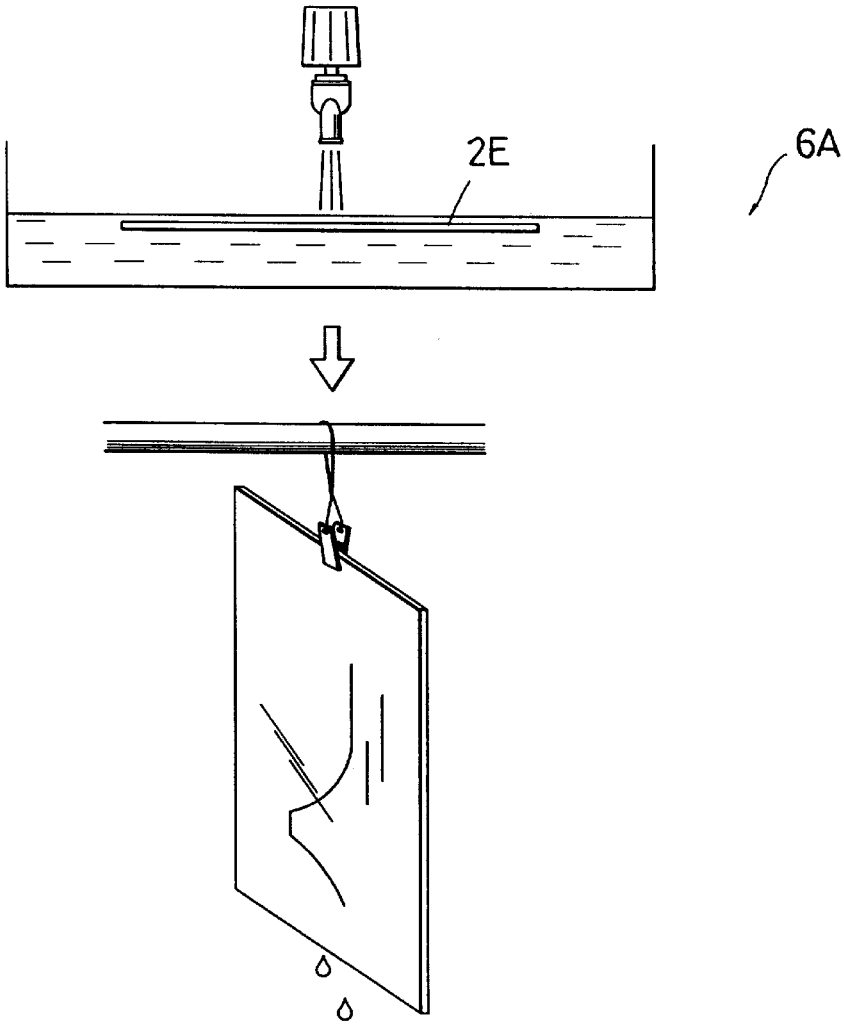
FIG. 15 is an explanation view of a tail end process.

Preferred embodiments of the present invention are described in more detail below referring to the accompanying drawings.

An understanding of the present invention may be best gained by reference FIGS. 1 to 4. FIGS. 1 to 4 illustrates the method of restoring the black-and-white picture under aging phenomena of a first embodiment of the present invention. The numeral 1 is a method of restoring the black-and-white picture under aging phenomena of this invention. The above restoring method 1 is composed of ethylene alcohol wipe process 3, silver mirror removal process 5, and tail end process 6.

The ethylene alcohol wipe process 3 is proceeded to wipe the surface of photograph dry plate or negative film 2 which are taken a picture of the black-and-white picture and preserved for a long term by ethylene alcohol 3*a* and allow it to dry. After the ethylene alcohol wipe process 3 is proceeded, the silver mirror removal process 5 is proceeded to wipe and drop the silver part 4 of the surface of the image of the photograph dry plate or negative film 2A by the silver mirror removal liquid 5*a*.

After the silver mirror removal process 5 is proceeded, the tail end process 6 is proceeded such that the photograph dry plate or negative film 2B which removed the silver mirror of the removal process 5 is washed in clear water by water or stream 6*a* and it can be dried.

In the ethylene alcohol wipe process 3, the dirt of the surface of the photograph dry plate or negative film 2 is washed by the wipe material 7 such as cotton, cloths including absorbent cottons to contain ethylene alcohol 3*a* enough. Then it dries the ethylene alcohol that adheres to the photograph dry plate or negative film 2 with natural seasoning or a heater, etc.

In the silver mirror removal process 5, the wipe material 7A such as cotton and cloths including the absorbent cottons contains a small amount of the silver mirror removal liquid 5*a*. The silver mirror part 4 is wiped until the sliver mirror can be removed and dropped.

The silver mirror removal liquid 5*a* used in the silver mirror removal process 5 is a mixture—one to ten part methanol and one part solution of salt of 0.5 to 25 percent.

The tail end process 6 is proceeded to remove the removal liquid 5*a* used in the above-mentioned removal process 5, the removal liquid 5*a* is dried by natural seasoning in the place without dust and where it is well ventilated after it washes in clear water to flush the silver mirror removal liquid 5*a* in stream 6*a*.

Other embodiments of the present invention will now be described referring to FIGS. 5 to 17. Through the drawings of the embodiments, like components are denoted by like numerals as of the first embodiment and will not be further explained in great detail.

A second embodiment of the present invention is shown in FIGS. 5 to 15. It is distinguished from the first embodiment by the fact that the restoring method 1 is replaced from another method including a head end process 8, process for spreading hardener 9, process for removing hardener 10, process for bleaching 11, process for removing bleacher 12, process for exposuring 13, process for developing 14, fixation process 15, process for removing hypo 16 and tail end process 6A.

In the head end process 8, water 8*a* cleans up the surface of photograph dry plate or negative film 2 and this process 8 makes the surface thereof to contain water. The process 8 is proceeded in about two minutes.

After the head end process 8 is preceeded, the surface of photograph dry plate or negative film is spread hardener 9*a* or the photograph dry plate or negative film itself dipped into the hardener 9*a* in about eight minutes such that the gelatin of the photograph dry plate or the image of the negative film 2C is hardened in the hardener spreading process 9.

After the gelatin of the image hardens in the hardener spreading process 9, the hardener 9*a* is removed from photograph dry plate or negative film 2D by washing in clear water about ten minutes in the hardener removal process 10.

After the hardener removal process 10 is proceeded, the silver compound in discoloring discoloration of the image and silver mirror part are bleached at bleacher 11*a* in the bleaching process 11 about two to five minutes.

In the bleacher removal process 12, the bleacher 11*a* is removed by washing in clear water about three minutes, and the cleaning solution 12*a* washes in clear water for about thirty minutes, after the bleacher 11 a which remains in the image part which cannot be removed by the washing in clear water is decomposed by cleaning solution 12*a* about five minutes.

In the exposuring process 13, the halogenated silver produced in the bleaching part according to the bleacher removal process 12 is exposed at the state that light is applied and exposed enough.

After that, it develops with develop solution 14*a* used in general in the development process 14 at about two to three minutes.

In the fixation process 15, after the development process 14 is proceeded, the exposed negative film soaks to stop solution 15*a* for about thirty seconds, the develop solution 14*a* is neutralized, and halogenated silver which remains on the photograph dry plate or negative film is decomposed for about five minutes by fixing solution 15*b*. After that, the fixing solution 15*b* is removed by washing in clear water for about three minutes.

After the fixation process 15 is proceeded, hypo ("hypo" means for sodium thiosulfate) which remained on photograph dry plate or negative film 2E is decomposed and removed by hypo removal liquid 16*a* at about six minutes in the hypo removal process 16.

After that, in the tail end process 6A, after the compound that remains on the photograph dry plate or negative film is removed almost completely by washing in clear water for about thirty minutes or more and it dries generally or naturally.

A restoring method according to the second embodiment may be proceeded.

In addition, the hardener 9*a,* as used at 20° C., which is the liquid used by this restoring method in processing temperature is composed of sodium sulfite of fifty gram, glacial acetic acid of twenty milliliter, and potassium alum of fifty gram.

The bleacher 11*a* is composed of A liquid which adds potassium permanganate of five gram to water of one liter, B liquid which adds hydrochloric acid of 100 milliliter of thirty-five percent to the water of one liter at the same amount of the A liquid, and liquid making to mixture liquid of twenty liter which mixes three to thirty-eight times is added to hydrobromic acid of 0.2 to 2 milliliter.

Cleaning solution 12*a* is potassium metabisulfite of one to ten percent.

Developer 14*a* uses the one used in general.

Stop solution 15*a* is the glacial acetic acid of three percent.

Fixing solution 15*b* is the mixture that sodium thiosulfate (hypo) of 240 gram is added to the water of one liter.

Hypo removal liquid 16*a* is sodium metasulfate of two percent.

Figure 16:
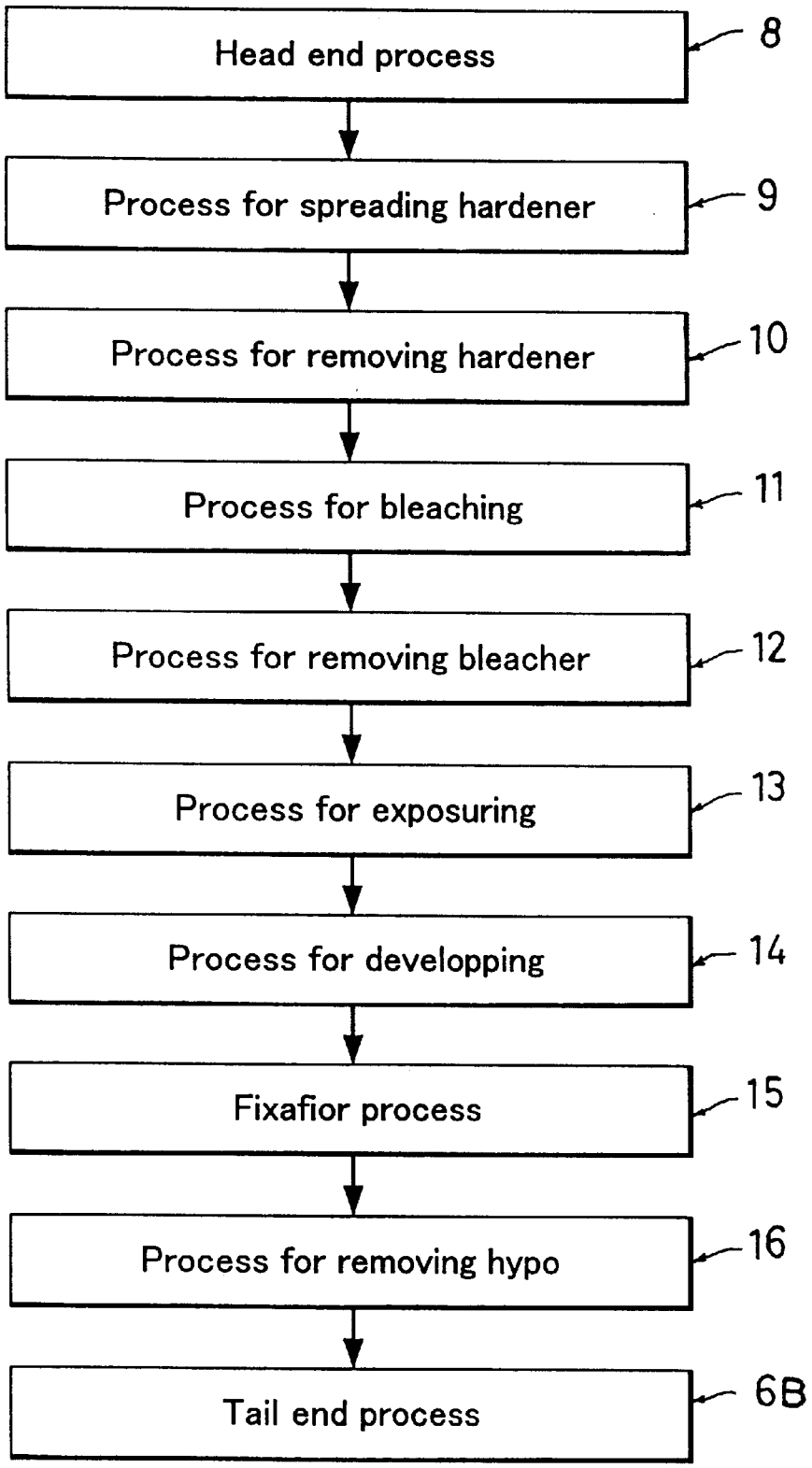
FIG. 16 is a view of a process showing a third embodiment of the present invention.
Figure 17:
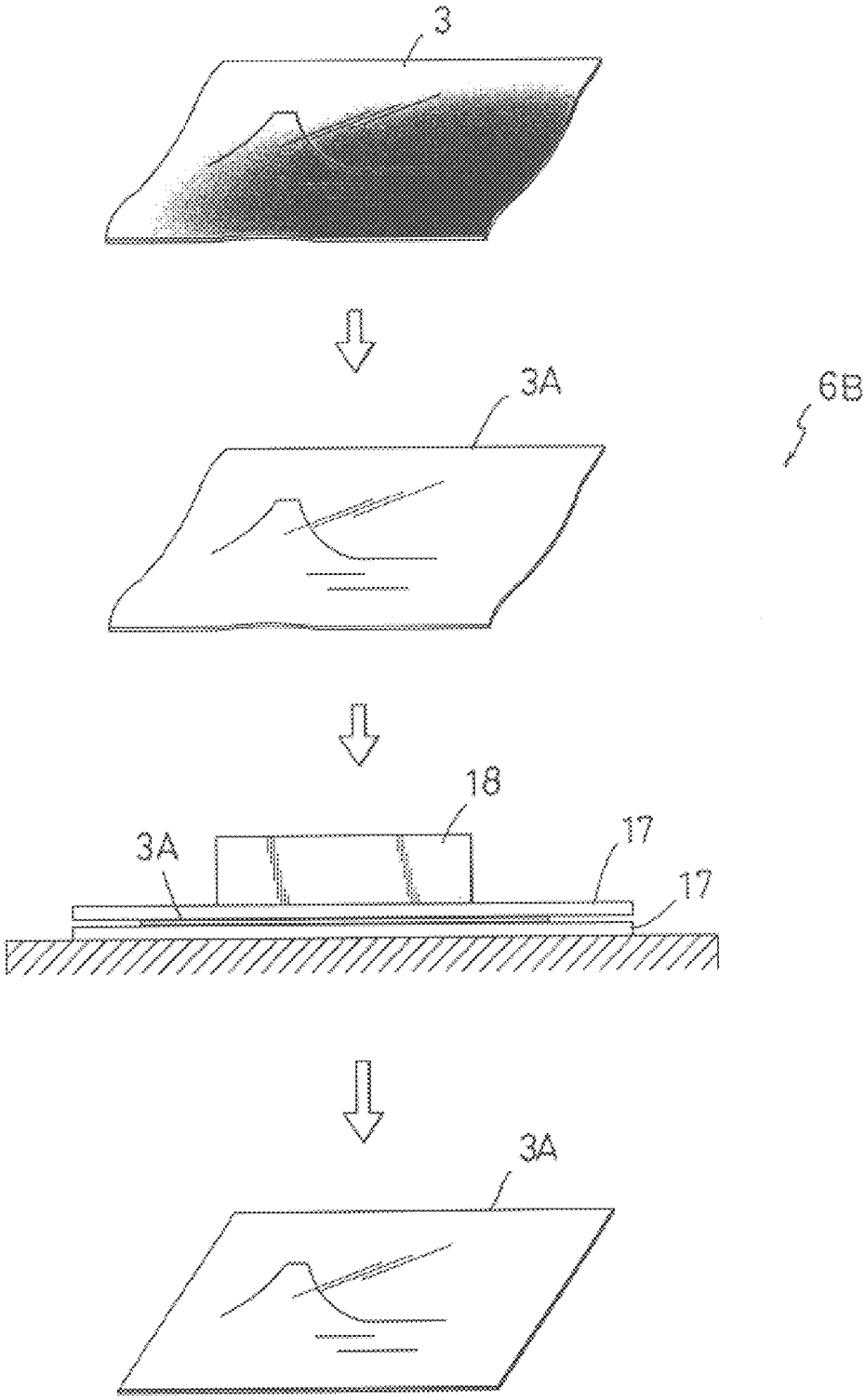
FIG. 17 is an explanation view of a tail end process.

A third embodiment of the present invention is shown in FIGS. 16 and 17. It is distinguished from the second embodiment by the fact that the tail end process 6A is replaced from with another method 6B. In this method 6B, a similar process of the second embodiment of the above-mentioned is done by using black-and-white picture 3, the black-and-white picture 3A which is naturally dry is placed between two flat pressurizing boards 17 and 17, and it pressurizes with a weight 18 or the like and is flattened.

A restoring method with the tail end process 6B according to the third embodiment may be proceeded.

As set forth above, the advantages of the invention are as follows:

(1) Method of restoring black-and-white picture under aging phenomena includes ethylene alcohol wipe process proceeded to wipe a surface of one of photograph dry plate and negative film which is taken the black-and-white picture and preserved for a long term by ethylene alcohol and allow it to dry; silver mirror removal process proceeded to wipe and drop a silver part on the surface of image of the photograph dry plate and the negative film by silver mirror removal liquid after the ethylene alcohol wipe process is proceeded; and tail end process proceeded such that one of the photograph dry plate and negative film which removed the silver mirror in the removal process is washed in dear water by water or stream and it can be dried. Accordingly, the silver mirror part on the surface of the image of the photograph dry plate and the negative film of the black-and-white picture under aging phenomena is removed, or a metallic uniting silver is disarranged, and the silver mirror part can be replaced with silver which makes original black.

Therefore, it is possible to restore it to the photograph dry plate and the negative film that obtains an original black-and-white picture.

(2) As discussed above, because it is possible to restore it to an original black-and-white picture in the ethyl alcohol wipe process, the silver mirror removal process, and the postprocessing process where dryness of washing in dear water is done, the work is easy comparing it, and it is possible to do in short course.

(3) Method of restoring black-and-white picture under aging phenomena includes head tail process proceeded that a surface of one of photograph dry plate, negative film and black-and-white picture is cleaned up by the water and it makes the surface thereof to contain water; process for spreading hardener proceeded that the hardener is spread on the surface of one of photograph dry plate, negative film and black-and-white picture or receives one of the photograph dry plate, negative film and black-and-white picture such that gelatin of one of the photograph dry plate and an image of the negative film is hardened after the head tail process is proceeded; process for removing the hardener proceeded that after the gelatin of the image hardens in the hardener spreading process, the hardener is removed from one of the photograph dry plate and negative film by washing in dear water; process for bleaching proceeded that, silver compound in discoloring discoloration of the image and silver mirror part are bleached at a bleach solution after the hardener removal process is proceeded; process for removing the bleach solution proceeded that the bleach solution is removed by washing in dear water, and cleaning solution is removed by washing in dear water after the bleach solution which remains in the image part which cannot be removed by the washing in dear water is decomposed by the cleaning solution; process for exposuring proceeded that halogenated silver which produced in the bleaching part according to the bleach solution removal process is exposed at the state that light is applied enough; process for developing proceeded that develops with develop solution after the exposuring process is proceeded; fixation process proceeded that the develop solution is neutralized by stop solution, and halogenated silver which remains on one of the photograph dry plate, negative film and black-and-white picture is decomposed by fixing solution, and after that, the fixing solution is removed by washing in clear water; process for removing hypo proceeded that, hypo remained on one of the photograph dry plate, negative film and black-and-white picture is decomposed and removed by hypo removal liquid after the fixation process is proceeded; and tail end process proceeded that compound remains on one of the photograph dry plate, negative film and black-and-white picture is removed almost completely by washing in clear water and then allowing to dry after the hypo removal process is proceeded, so that it is possible to replace it with silver which makes original black by removing the silver mirror part on the surface of the image of the photograph dry plate of the black-and-white picture changed under aging phenomena, the negative film, and the black-and-white picture and the silver compounds.

Therefore, it is possible to restore it to the black-and-white picture, the photograph dry plate and the negative film that obtains an original black-and-white picture.

What is claimed is:

1. Method of restoring black-and-white picture under aging phenomena includes:

head tail process proceeded that a surface of one of photograph dry plate, negative film and black-and-white picture is cleaned up by the water and it makes the surface thereof to contain water;

process for spreading hardener proceeded that the hardener is spread on the surface of one of photograph dry plate, negative film and black-and-white picture or receives one of the photograph dry plate, negative film and black-and-white picture such that gelatin of one of the photograph dry plate and an image of the negative film is hardened after the head tail process is proceeded;

process for removing the hardener proceeded that after the gelatin of the image hardens in the hardener spreading process, the hardener is removed from one of the photograph dry plate and negative film by washing in clear water;

process for bleaching proceeded that silver compound in discoloring discoloration of the image and silver mirror part are bleached at a bleach solution after the hardener removal process is proceeded;

process for removing the bleach solution proceeded that the bleach solution is removed by washing in dear water, and cleaning solution is removed by washing in clear water after the bleach solution which remains in the image part which cannot be removed by the washing in clear water is decomposed by the cleaning solution;

process for exposuring proceeded that halogenated silver which produced in the bleaching part according to the bleach solution removal process is exposed at the state that light is applied enough;

process for developing proceeded that develops with develop solution after the exposuring process is proceeded;

fixation process proceeded that the develop solution is neutralized by stop solution, and halogenated silver which remains on one of the photograph dry plate, negative film and black-and-white picture is decomposed by fixing solution, and after that, the fixing solution is removed by washing in clear water;

process for removing hypo proceeded that, hypo remained on one of the photograph dry plate, negative film and black-and-white picture is decomposed and removed by hypo removal liquid after the fixation process is proceeded; and tail end process proceeded that compound remains on one of the photograph dry plate, negative film and black-and-white picture is removed almost completely by washing in clear water and then allowing to dry after the hypo removal process is proceeded.

2. The Method of restoring the black-and-white picture under aging phenomena according to claim 1, wherein the tail end process proceeds a natural seasoning.

* * * * *